US005186413A

United States Patent [19]

Deakin

[11] Patent Number: 5,186,413

[45] Date of Patent: Feb. 16, 1993

[54] STABILIZATION SYSTEMS

[75] Inventor: Richard S. Deakin, Haslemere, United Kingdom

[73] Assignee: British Aerospace plc, Farnborough Hants, England

[21] Appl. No.: 705,965

[22] Filed: May 28, 1991

[30] Foreign Application Priority Data

Jun. 6, 1990 [GB] United Kingdom ..... 9012602

[51] Int. Cl.[5] ..... F42B 10/02

[52] U.S. Cl. ..... 244/1 TD; 244/1 R; 244/3.28; 102/388

[58] Field of Search ..... 244/1 TD, 1 R, 3.28, 244/3.29, 3.23, 3.3; 102/388

[56] References Cited

U.S. PATENT DOCUMENTS 3,047,251 7/1962 Lewis ..... 244/34 A
3,603,533 9/1971 Stripling ..... 244/3.23
4,426,048 1/1984 Midren ..... 244/3.23
4,954,110 9/1990 Warnan ..... 244/1 TD
4,964,593 10/1990 Kranz ..... 244/3.23

*Primary Examiner*—Joseph F. Peters, Jr
*Assistant Examiner*—Anne E. Bidwell
*Attorney, Agent, or Firm*—Nixon & Vanderhye

[57] ABSTRACT

A stabilization system for a towed aerodynamic body 1. The body is provided with two, contra-rotating tubular shrouds 3, 4 each fitted with a set of vanes 5, 6. When the towed body is disturbed by the towing aircraft's wake, the gyroscopic inertia caused by rotation of the shrouds exerts a damping effect on the subsequent oscillatory motion of the towed body. In one embodiment, the shrouds are coupled by wheels which constrain the shrouds to rotate in opposite senses. Hence gyroscopic precession effects due to each rotating shroud cancel.

7 Claims, 2 Drawing Sheets

STABILIZATION SYSTEMS

BACKGROUND OF THE INVENTION

This invention relates to stabilisation of aerodynamic bodies and is particularly applicable to bodies which are towed by an aircraft.

It has been found that bodies which are towed by aircraft are subject to disturbance from the wake turbulence of the aircraft. In severe cases, the ensuing pitching movements of the body can cause the tow line to break.

This invention aims to provide a means for reducing the oscillations of a towed body.

SUMMARY OF THE INVENTION

The invention therefore comprises an aerodynamic body of generally cylindrical form, said body being provided with front and rear tubular shrouds which are rotatable about the longitudinal axis of the body, and means for compelling the shrouds to rotate in opposite senses when the body is in motion.

The invention thus utilises the principle of gyroscopic inertia to stabilise the towed body when in flight.

The invention has the further advantages of being inexpensive and simple to manufacture and being maintenance free.

Because the body is provided with two shrouds rotating in opposite senses, gyroscopic precession effects due to each spinning shroud oppose one another. For complete cancellation, it is necessary for the two shrouds to rotate at the same speed.

In one embodiment, vanes are fitted to the walls of the shrouds and are inclined so that the shrouds rotate in opposite senses when the body is in motion.

Preferably, the vanes on the shroud mounted towards the front of the body are mounted on the internal wall of the shroud, and the vanes on the shroud mounted towards the rear of the body are mounted on the external wall of the shroud. This measure ensures that the rear shroud spins at a similar speed to the front shroud by using the free stream air rather than air that has already been de-energised after propelling the front shroud.

In an alternative embodiment the front and rear shrouds (each of which carries a set of vanes) are coupled by one or more wheels. The presence of the wheel(s) ensures that the shrouds rotate at the same speed, irrespective of the aerodynamic forces acting on them.

BRIEF DESCRIPTION OF THE DRAWINGS

Some embodiments of the invention will now be described, by way of example only, with reference to the drawings of which.

DETAILED DESCRIPTION OF THE PREFERRED EMBODIMENTS

Figure 1:
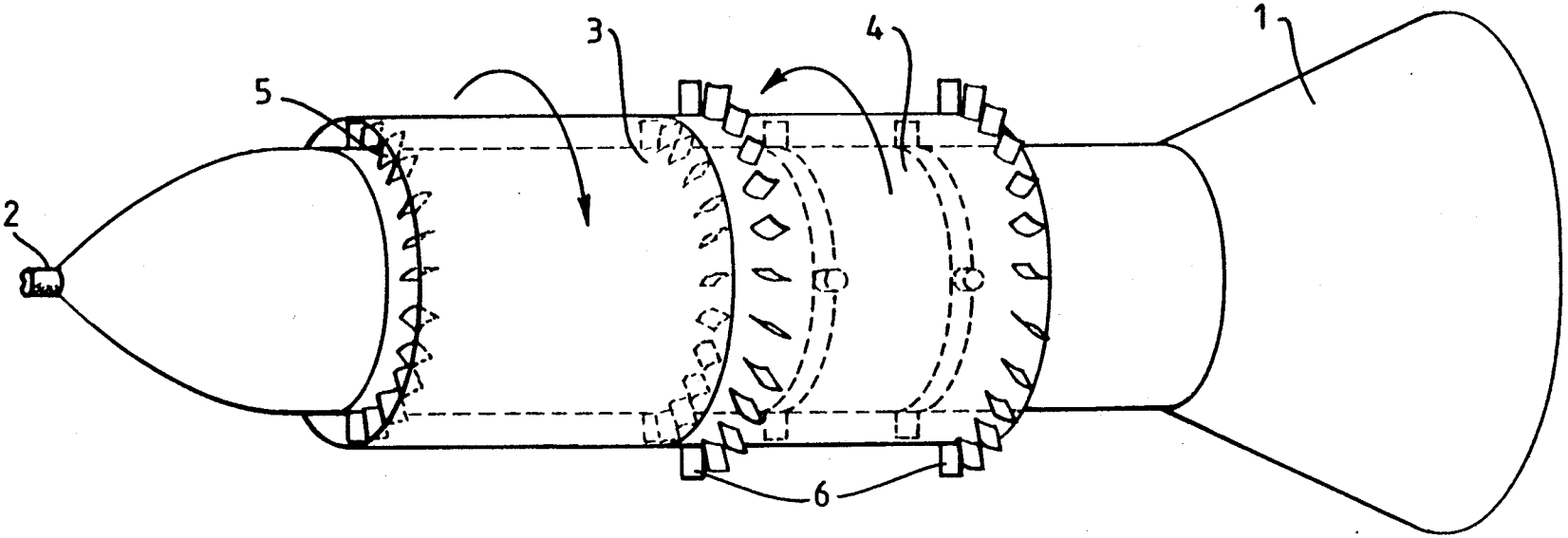
FIG. 1 and FIG. 2 show side views of alternative embodiments of a stabilised aerodynamic body in accordance with the invention.

FIG. 1 shows an aerodynamic body 1 attachable to an aircraft (not shown) by means of a tow line 2. A front shroud 3 and rear shroud 4, both of tubular form, envelope part of the body 1. Each shroud 3, 4 is free to rotate about the longitudinal axis of the body 1. A set of vanes 5 is mounted on the interior wall of the front shroud 3. The exterior wall of the rear shroud 4 carries a further set of vanes 6. The vanes 5 and 6 are inclined so that when the body is in motion, the shrouds 3 and 4 rotate in opposite senses.

Figure 4:
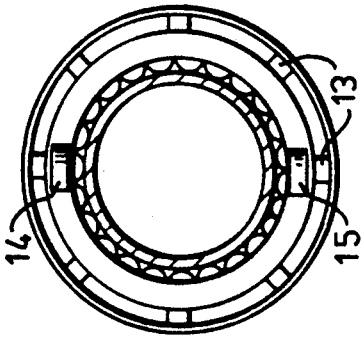
Figure 2:
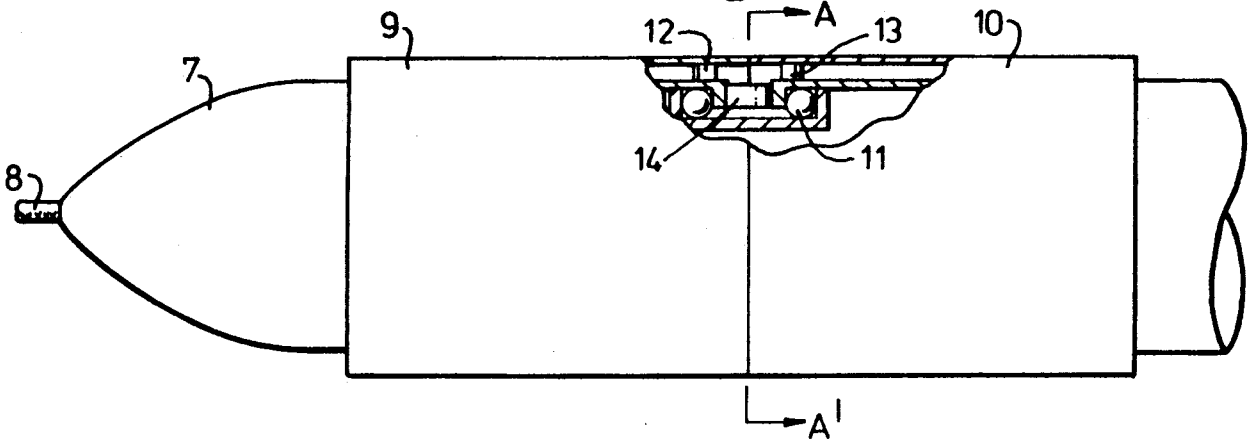
Figure 3:
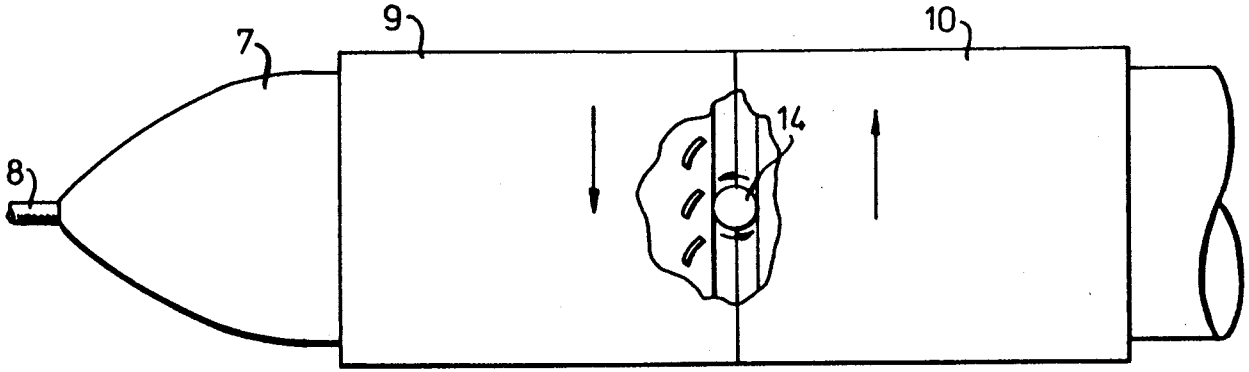
FIG. 3 is a plan view of the embodiment of FIG. 2 and, FIG. 4 is a cross-section on a line A—A' of FIG. 2.

Referring now to FIGS. 2, 3 and 4 which show an alternative embodiment. FIGS. 2 and 3 show part of a towed body 7 connected to a towline 8 and carrying front and rear shrouds, 9, and 10 respectively. The shrouds 9, 10 rotate in bearings 11 and each carry a respective set of vanes 12, 13 on their interior walls.

Two wheels 14, 15 diametrically opposed across the towed body 7 couple the two shrouds 9, 10 together. The wheels ensure that if one of the shrouds is rotating, the other shroud would be forced to rotate at the same speed but in the opposite direction, irrespective of the aerodynamic forces acting on it.

In the case of either embodiment, when the towed body is disturbed by the towing aircraft's wake turbulence, the gyroscopic inertia created by the rapid spinning of the front and rear shrouds exerts a damping effect on any ensuing oscillatory motion of the towed body.

I claim:

1. A means for stabilizing an aerodynamic body of generally cylindrical form having a longitudinal axis, said stabilizing means comprising:

front and rear tubular shrouds, each of said shrouds comprising a means for enveloping a portion of said body and is rotatable with respect to said body about said longitudinal axis; and aerodynamically driven means for compelling said shrouds to rotate in opposite senses when said body is in motion.

2. A means for stabilizing as claimed in claim 1 wherein each of said shrouds includes vanes, the vanes being inclined so that said shrouds rotate in opposite senses when the aerodynamic body is in motion.

3. A means for stabilizing as claimed in claim 2 in which said vanes of said front shroud are mounted on an internal wall of said front shroud and said vanes of said rear shroud are mounted on an external wall of said rear shroud.

4. A means for stabilizing as claimed in claim 1 in which vanes are fitted to each of said shrouds and said shrouds are coupled by at least one wheel which ensures that said shrouds rotate at the same speed when said aerodynamic body is in motion.

5. An aerodynamic body of generally cylindrical form, said body being provided with front and rear tubular shrouds which are rotatable about a longitudinal axis of the body and means for compelling said shrouds to rotate in opposite senses when said body is in motion in which vanes are fitted to each of said shrouds, the vanes being inclined so that said shrouds rotate in opposite senses when the aerodynamic body is in motion in which said vanes of said front shroud are mounted on an internal wall of said front shroud and said vanes of said rear shroud are mounted on an external wall of said rear shroud.

6. An aerodynamic body of generally cylindrical form, said body being provided with front and rear tubular shrouds each shroud comprising a means for enveloping a portion of said body, said shrouds rotatable about a longitudinal axis of the body and aerodynamically driven means for compelling said shrouds to rotate in opposite senses when said body is in motion in which vanes are fitted to each of said shrouds and said shrouds are coupled by at least one wheel which ensures that said shrouds rotate at the same speed when said aerodynamic body is in motion.

7. A means for stabilizing an aerodynamic body of generally cylindrical form having a longitudinal axis, said stabilizing means comprising:

front and rear tubular shrouds, each of said shrouds comprising a means for enveloping a portion of said body, said shrouds rotatable at least with respect to each other about said longitudinal axis; and aerodynamically driven means for compelling said shrouds to rotate in opposite senses when said body is in motion.

* * * * *